United States Patent [19]

Joshi et al.

[11] Patent Number: 4,912,931

[45] Date of Patent: Apr. 3, 1990

[54] STAGED LOW $NO_x$ GAS TURBINE COMBUSTOR

[75] Inventors: Narendra D. Joshi, Phoenix, Ariz.; Frederick E. Moreno, Los Altos, Calif.; Creighton D. Hartman, San Francisco, Calif.

[73] Assignee: PruTech II, San Jose, Calif.

[21] Appl. No.: 109,118

[22] Filed: Oct. 16, 1987

[51] Int. Cl.[4] ..... F23R 3/46

[52] U.S. Cl. ..... 60/732; 60/753

[58] Field of Search ..... 60/732, 753, 754, 752, 60/39.32; 110/336; 52/404; 432/264; 431/350, 353

[56] References Cited

U.S. PATENT DOCUMENTS

| | | | |
|---|---|---|---|
| 4,222,338 | 9/1980 | Adams | 110/336 |
| 4,273,824 | 6/1981 | McComas et al. | 60/753 |
| 4,379,382 | 4/1983 | Sauder | 52/506 |
| 4,698,948 | 10/1987 | Yamashita et al. | 110/336 |
| 4,709,643 | 12/1987 | Moreno et al. | 60/753 |
| 4,829,734 | 5/1989 | Schraff | 110/336 |

FOREIGN PATENT DOCUMENTS

| | | | |
|---|---|---|---|
| 0100233 | 8/1981 | Japan | 60/753 |

*Primary Examiner*—Leonard E. Smith
*Assistant Examiner*—Timothy S. Thorpe
*Attorney, Agent, or Firm*—Flehr, Hohbach, Test, Albritton & Herbert

[57] ABSTRACT

A staged low $NO_x$ gas turbine combustor includes a refractory fibrous thermally insulatively lined primary combustion chamber, operating fuel-rich, and exhausting through a throat into a metallic secondary combustion chamber containing a fuel-lean secondary combustion zone in which combustion is completed. A radiation cooling zone is provided intermediate the throat and secondary combustion zone for cooling of the primary combustion products before quick quench in the secondary combustion zone. The fibrous lining of the primary combustion chamber is densified at its interior surface with a refractory such as zirconia or silicon carbide to inhibit flame erosion. The liner is wrapped with a supportive compliant blanket of fibrous refractory insulation. Air cooling of the metallic wall of the secondary chamber surrounding the radiation cooling zone is intensified relative to the remainder of the secondary combustion chamber.

5 Claims, 2 Drawing Sheets

STAGED LOW $NO_x$ GAS TURBINE COMBUSTOR

BACKGROUND OF THE INVENTION

The present invention relates in general to gas turbine combustors and, more particularly, to an improved low $NO_x$ staged gas turbine combustor especially well suited for burning nitrogen-containing heavy crude oil.

DESCRIPTION OF THE PRIOR ART

Nitrogen oxides ($NO_x$) are an air pollutant formed primarily in combustion processes. $NO_x$ can be formed in two ways. "Thermal $NO_x$" is formed when the temperature of the combustion process exceeds about 2800° F. causing nitrogen and oxygen in the combustion air to combine to form NO. "Fuel $NO_x$" is formed when nitrogen contained within the fuel (such as heavy crude oil which has an API gravity between 10° and 20°, and which contain 0.6% to 0.8% nitrogen) preferentially emerges from the combustion process in the form of $NO_x$.

The preferred strategies for the control of fuel $NO_x$ and thermal $NO_x$ are well documented and widely reported in the literature. To control thermal $NO_x$, the peak combustion temperatures must be lowered. In gas turbines, this is typically accomplished by injecting water or steam in the combustion chamber.

Temperature reduction does not reduce the formation of fuel $NO_x$. In this case, the preferred strategy for gas turbines is to employ staged combustion in which the combustion process is divided into at least two stages, a primary combustion zone followed by a secondary combustion zone and the two zones being separated by a narrow throat region.

Fuel is initially injected into the primary combustion zone which is operated fuel-rich, i.e., there is 20 to 120 percent more fuel than can be burned by the available air. This creates a chemical environment rich in hydrocarbon fragments which reduces the formation of NO.

The exhaust flow from the primary combustion zone is directed through a throat of reduced diameter where substantial amounts of additional air are quickly added to reduce the temperature. This is termed the "quench zone". The flow of combustion products exiting the throat region is slowed as it enters the secondary combustion zone where still more air is added and combustion is completed with substantial excess air.

Finally, dilution air is added to the exhaust of the secondary combustion chamber to reduce the temperature further prior to entrance to the turbine wheel. Dilution is required to reduce temperature to levels that can be tolerated by the metallic parts of the turbine.

The aforedescribed type of combustor is termed a "rich-quench-lean" (RQL) or "rich-burn-quick-quench" (RBQQ) combustor, and varients of this type of combustor are widely reported in the literature. Such combustors must start and heat-up quickly, in a matter of seconds in a gas turbine. The combustor must tolerate not only high temperatures, but also thermal shock. It has been proposed to make the wall of the primary combustion chamber of a temperature-resisting alloy sheet metal. To reduce wall temperature, the sheet metal wall is sprayed with a thin layer of an insulating ceramic thermal barrier coating, such as alumina, and the backside of the wall is subjected to a high velocity flow of air to transfer heat away from the wall. This type of heat transfer reduces the temperature in the primary combustion zone, thus, slowing $NO_x$-producing chemical reactions. In spite of these precautions, the high temperatures in the primary zone (typically 3000° F.) create hot spots on the combustor wall, i.e., locations with temperatures above 1600° F., which lead to reduced wall lifetime and localized burn-through. Additionally, the thin protective ceramic coating frequently spalls off the metal wall because of the differing thermal expansion coefficients between the metal wall and the ceramic coating.

The quick-quench is accomplished by injecting air through slots or holes in the throat to obtain the fastest quench possible. However, the throat is a region of intense mixing because of the high velocity of the flow, and the high rate of mixing can create high rates of combustion and high temperatures leading to the formation of thermal $NO_x$.

Because of the generally poor operating performance and limited lifetime of prior art combustors, no staged combustion "rich-quench-lean" combustors have been applied to commercially available gas turbine engines. A proposed RQL combustor is disclosed in a report titled: "Low $NO_x$ Heavy Fuel Combustor Concept" No. DOE/NASA/0148-1 by A. S. Novick, D. L. Troth, of the Detroit Diesel Allison Division of General Motors Corp. dated October 1981.

SUMMARY OF THE PRESENT INVENTION

The principal object of the present invention is the provision of an improved low $NO_x$ staged gas turbine combustor especially well suited for burning nitrogen-containing heavy crude oils.

In one feature of the present invention, the primary combustion chamber is lined with a layer of porous, fibrous refractory thermally insulative material which has been infiltrated with a coating of refractory material such as silicon carbide or zirconia so as to produce a region of increased density in the resultant lining at the interior surface thereof whereby the refractory lining is rendered resistant to erosion by combustion products within the primary combustion chamber of the gas turbine combustor.

In another feature of the present invention, the density of the infiltrated region of the fibrous refractory thermally insulative lining is increased by coating the interior surface of the lining with a liquid containing zirconia and heating the coated lining to an elevated curing temperature to cure the coated fibers.

In another feature of the present invention, the infiltrated fibrous refractory lining is infiltrated by reacting a chemical vapor at subatmospheric pressure and at an elevated deposition temperature with the interior surface of the insulative lining to cause reactive chemical vapor constituents to infiltrate the lining from the interior surface and to deposit a refractory coating on the infiltrated fibers.

In another feature of the present invention, the thermally insulative liner of the primary combustion chamber includes a rigid free-standing fibrous member supported at its exterior from the inside wall of a metallic primary combustion chamber via the intermediary of a blanket of compliant, fibrous refractory thermally insulative material, whereby the support induced stresses are generally evenly distributed over the exterior surface of the liner and whereby differential coefficients of expansion are accommodated between the liner and the metallic shell of the combustion chamber occasioned by rapid thermal cycling of the turbine combustor.

In another feature of the present invention, a radiation cooling zone is provided between the primary combustion zone and the secondary combustion zone for cooling the exhaust of the primary combustion zone before introducing the secondary combustion air in the secondary combustion zone, whereby peak temperatures in the secondary combustion zone are maintained below 2700° F. to reduce thermal $NO_x$ emissions.

In another feature of the present invention, the wall of the secondary combustion chamber which surrounds the radiation cooling zone is perforated with air-cooling holes and metallic cooling members overlay the interior of the perforations to receive cooling air and remove heat collected by thermal radiation emanating from the exhaust gas in the radiation cooling zone. The air-cooling perforations and members are arranged such that the cooling intensity is greater in the radiation cooling zone than in the remaining portion of the secondary combustion chamber.

Other features and advantages of the present invention will become apparent upon a perusal of the following specification taken in connection with the accompanying drawings, wherein:

DESCRIPTION OF THE PREFERRED EMBODIMENTS

Figure 1:
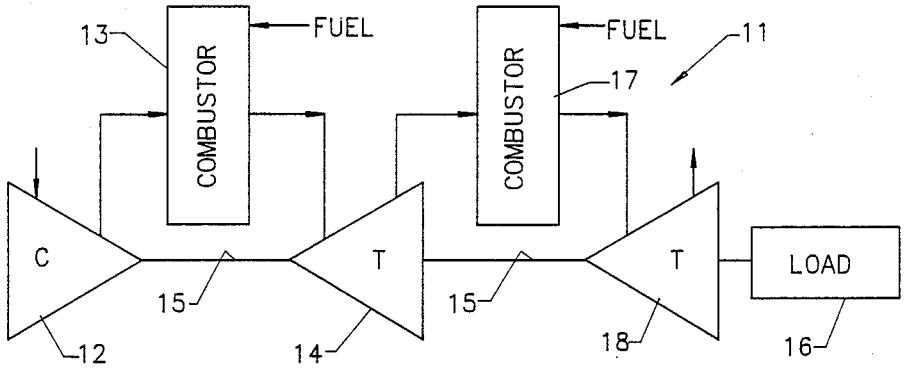
FIG. 1 is a schematic diagram, partly in block diagram form of a gas turbine employing the gas turbine combustors of the present invention.

Referring now to FIG. 1, there is shown a gas turbine 11 incorporating features of the present invention. Briefly, air is inducted into a compressor stage 12 wherein it is compressed to approximately 10 to 12 atmospheres and fed into a gas turbine combustor 13 where it is mixed with fuel and combusted in a staged combustor of the present invention to produce hot exhaust gas which is fed into a turbine 14 coupled to a shaft 15 for driving the shaft and for performing useful work such as driving a load 16, such as an electrical generator. The exhaust from the turbine stage 14 is fed into a re-heat combustor 17 having a design substantially the same as the first combustor 13 wherein additional fuel is added to the turbine exhaust and combusted to provide combustion products fed to a second turbine stage 18. The exhaust from the turbine stage 18 is commonly employed for supplying heated air to drive a steam generator for producing steam for enhanced oil recovery.

Figure 2:
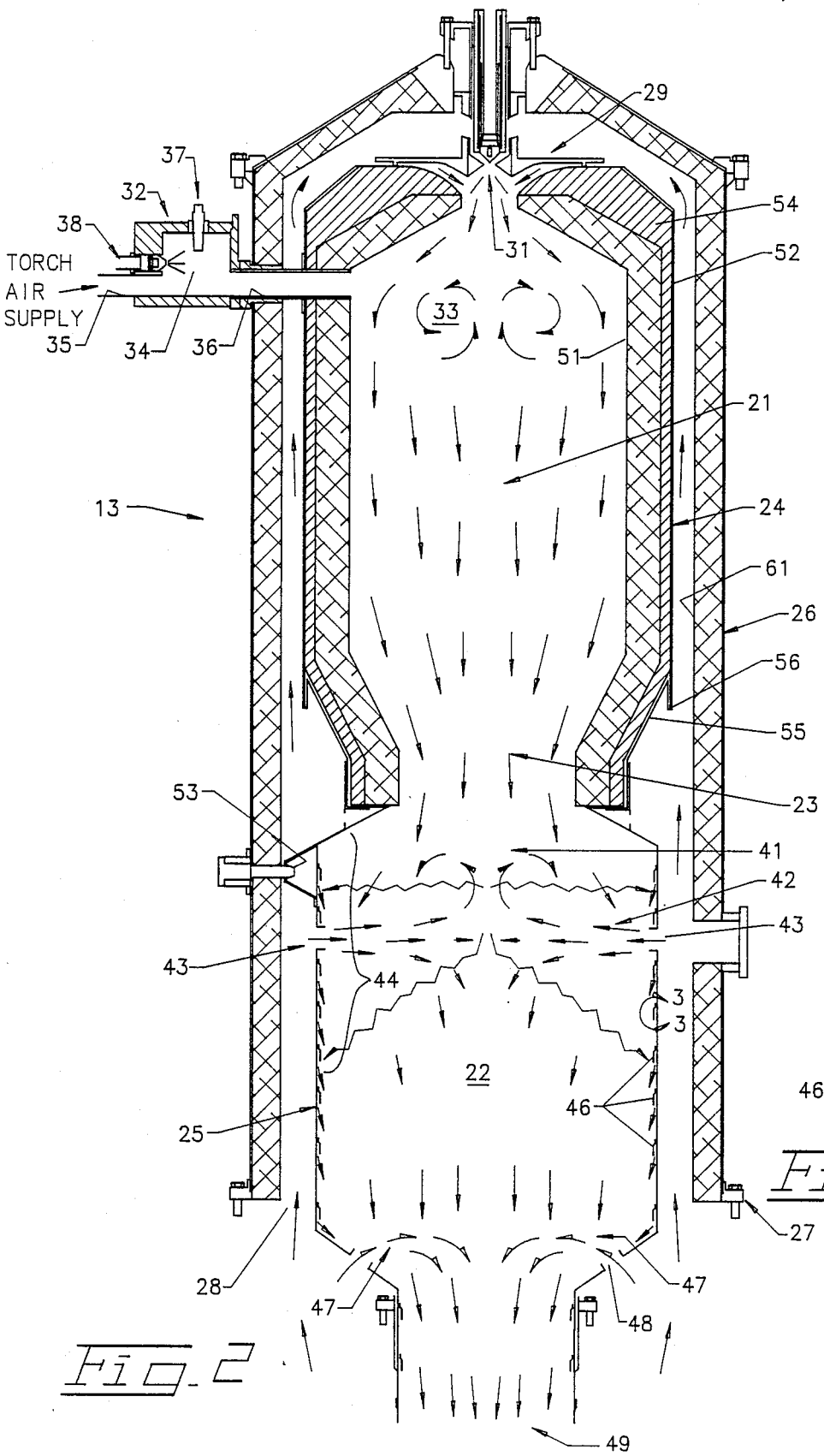
FIG. 2 is a longitudinal sectional view of a gas turbine combustor employing features of the present invention.

Referring now to FIG. 2, there is shown the staged gas turbine combustor 13 incorporating features of the present invention. The gas turbine combustor 13 is of the staged variety, i.e., having a primary combustion zone 21 in which fuel-rich combustion is obtained followed by a secondary combustion zone 22 where fuel-lean combustion is obtained. A throat region 23 is provided between the primary combustion zone 21 and the secondary combustion zone 22 for isolating the combustion conditions in the two zones.

The primary combustion zone 21 is contained within a primary combustion chamber 24 and the secondary combustion zone 22 is contained within a secondary combustion chamber 25. The primary and secondary combustion chambers 24 and 25 are mechanically coupled together and supported within a pressure vessel 26 bolted at one end 27 to the gas turbine. Compressed air at approximately 11 atmospheres is fed into the combustor 13 through an annulus 28 defined between the interior of the cylindrical pressure vessel 26 and the cylindrical primary and secondary combustion chambers 24 and 25. A portion of the compressed air is fed into the upper end of the primary combustion chamber 24 through a set of swirl vanes 29 which impart swirl to the inducted air so as to cause the flow to diverge when entering the primary combustion zone 21. The diverging flow creates a re-circulation flow which stabilizes the flame in the primary combustion zone 21. Fuel, such as California heavy crude oil having an API gravity between 10° and 20° and which contains 0.6% to 0.8% nitrogen, is sprayed into the swirling flow exiting the swirl vanes by means of a fuel nozzle 31. The swirling air flow entering the combustion zone 21 typically has a swirl number as of 1. The primary combustion zone flow takes on a one-dimensional character characterized as "plug flow". The residence time of the flow is preferably 140 milliseconds or longer within the primary combustion zone and reaches a temperature of nominally 3000° F. The average flow velocity through the primary combustion zone 21 is approximate 16′ per second and the velocity increases to nominally 50′ per second as the flow exits through a throat 23.

The mixture of air and fuel in the primary combustion zone 21 is initially ignited by means of a torch igniter 32 which shoots a flame into the re-circulation zone 33. The torch igniter 32 includes a cylindrical ignition chamber 34 connected serially with an air inlet pipe 35 and a exhaust or flame tube 36 penetrating through the wall of the primary combustion chamber 24. A spark plug 37 is provided in the ignition chamber 34 for igniting atomized fuel sprayed into the ignition chamber 34 by means of an atomizer 38. The torch igniter is operated for a few seconds to initiate combustion and thereafter combustion is maintained due to the high temperature of the inside wall sof the primary combustion chamber 24.

The total heat release in the primary zone is nominally 1.94 megawatts of thermal energy. The pressure drop of a flow across the swirler 29 and the other portions of the combustor is nominally 3% of the inlet absolute pressure.

The combustion products exiting the primary combustion zone 21 at the throat 23 are cooled by radiation to the cooled wall of the secondary combustion chamber 25 in a region surrounding the radiation cooling zone 41. In the radiation cooling zone, the combustion products are cooled from approximately 3000° F. to 1650° F. before they encounter the flow of a converging ring of secondary air jets 42 which are formed by secondary air passing through a ring of secondary air ports 43. The secondary air jets 42 penetrate the primary exhaust flow and impinge on each other creating a region of intense quenching, mixing and secondary combustion in the secondary combustion zone 22. By cooling the exhaust flow of primary combustion products prior to secondary combustion, the peak flame temperatures in the secondary combustion zone 22 are reduced to a maximum value of nominally 2700° F. thus, inhibiting the formation of thermal $NO_x$. The thermal heat release in the secondary combustion zone 22 is nominally 1.25 megawatts of thermal energy, and the overall stoichiometry in the secondary zone 22 is fuel lean, i.e., equivalence ratio $\phi$ of approximately 1.66.

In the radiation cooling zone 41, the primary combustion zone exhaust products are at high temperature, i.e., 3000° F. and highly luminous. Therefore, there is a heavy thermal radiation load on that portion 44 of the wall of the secondary combustion chamber 25 which surrounds the radiation cooling zone 41 and which extends somewhat downstream thereof as the secondary air jets 42 are transparent to the radiation emanating from the radiation cooling zone 41.

Figure 3:
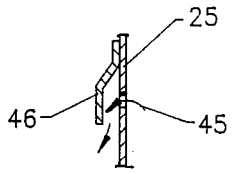
FIG. 3 is an enlarged detail view of a portion of the structure of FIG. 2 delineated by line 3—3.

The wall of the secondary combustion chamber is cooled by means of rings of cooling perforations 45 (see FIG. 3) passing through the wall of the chamber for inducting a flow of cooling air through the wall. A ring-shaped cooling member 46 overlays the ring of perforations 45 on the interior wall of the chamber 25 to receive the flow of cooling air in heat-exchanging relation therewith for removing heat from the cooling rings 46. The ring members 46 are made of the same material as the wall 25 of the secondary combustion chamber. The radiation load is highest near the exit of the primary zone, i.e., in the region 44 and, therefore, the distribution of cooling rings 46 is arranged so that there are more cooling rings per unit length of the axial length of the secondary combustion chamber 25 in the vicinity of the radiation cooling portion 44 to compensate for the locally higher thermal radiation loading in this region. The cooling air from the numerous small holes or perforations 45 merges to form a film of cooling air which flows along the inner surface of the secondary combustion chamber 25.

The unburned hydrocarbon constituents of the exhaust from the primary combustion zone 21 are completely combusted in the secondary combustion zone 22. The exhaust from the secondary combustion zone encounters entering converging jets 47 of dilution air produced by air passing through a ring of dilution air ports 48 near the exit of the secondary combustion chamber 25. The dilution air jets 47 promote intense mixing so as to create a uniform temperature profile at the exit 49 of the combustor 13. The exhaust at 49 is at a temperature which has been reduced to a nominal value of 1500° F. and the flow velocity is nominally 300' per second. The exhaust at 49 is thence fed to the turbine 14.

The primary combustion chamber 24 is lined at its interior with a rigid free-standing liner 51 of a fibrous refractory thermally insulative material. The liner 51, in a typical example, has a thickness of 1.5" and is made by pumping a slurry of alumina fibers such as Saffil alumina ceramic fibers made by ICI Co. of England through a perforated form so that the fibers are collected in a felt-like structure. The fibers are coated with a thermal setting bonding material and the free-standing liner 51 is heated to a curing temperature which causes the binding material to bind the fibers together to provide a relatively low-density porous freestanding rigid liner 51, having a density as of 15 pounds per cubic foot.

The interior surface of the liner 51 is preferably densified with a refractory material so as to render the interior surface of the liner 51 resistant to erosion by combustion products produced in the primary combustion zone 21. More particularly, the densification at the interior surface is more clearly shown in the plot of lining density vs. liner radius of FIG. 4. At the interior surface Ri the lining density approaches 180 lbs. per cubic foot and within approximattely 1/32 of an inch, the density of the lining drops to approximately 45 pounds per cubic inch and then linearly falls off in density to 15 pounds per cubic foot at the outer surface of the liner 51.

The liner 51 may be densified utilizing two methods. In a first method, the interior surface of the liner 51 is painted either by brush or spraying with a zirconia coating such as ZO-MOD commercially available from Zyp Coatings Inc. of Oakridge, Tenn. The zirconia coating material then is wicked into the liner penetrating up to ¼". The coating is then cured by exposure to temperatures exceeding 1800° F. for one hour. The resulting coating has a density profile as shown in FIG. 4 and has a low coefficient of thermal absorbtivity of nominally 0.3 minimizing the effect of radiant heat flux from the flame in the primary combustion zone 21.

Figure 4:
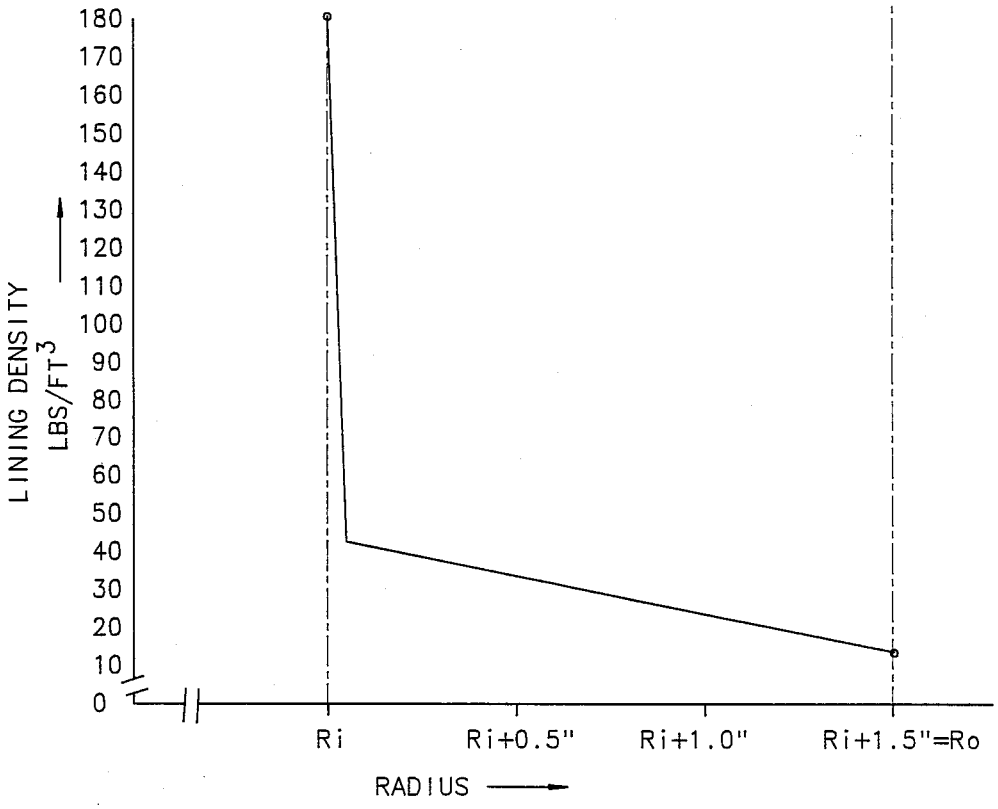
FIG. 4 is a plot of lining density in pounds per cubic foot vs. radius of the fibrous lining.

In a second densification method, the liner 51 is densified with silicon carbide or other refractory material which is deposited using a method of chemical vapor deposition in which the ceramic fiber preform 51 is inserted into a vacuum oven, heated, and then chemical vapors are fed into the oven and permitted to penetrate the liner and react on the surface to create the desired densification as shown in FIG. 4. Chemical vapor infiltration and deposition creates an inner surface which can have nearly 100% of theoretical density. Densification of the liner 51 utilizing the method of chemical vapor deposition can be obtained from Refractory Composites Inc. of Los Angeles, Calif.

Densifying the liner 51, as above described, provides an inner surface for the liner 51 which has maximum resistance to flame erosion. However, the thermal shock-resisting properties of the liner 51 are retained along with the good insulating properties which are characteristic of ceramic fiber structures formed utilizing the slurry deposition technique. The result is a liner 51 that retains the heat within the primary combustion zone 21, thereby increasing the flame temperature in the primary zone, thus accelerating the $NO_x$ reducing chemical reactions that operate in this zone.

The outer wall 52 of the primary combustion chamber 24 is fabricated from a high temperature alloy such as RA330, available from the Rolled Alloys Co. of Los Angeles, Calif. This cylindrical wall 52, as of 0.125" in thickness, is supported and located by a ring of support pins 53 passing radially through the wall of the pressure vessel 26.

The free-standing liner 51 is installed within the cylindrical shell 52 of the primary combustion chamber 24 by first wrapping the free-standing formed liner 51 with a compliant blanket of fibrous refractory insulation 54 such as CERA blanket material manufactured by Johns Mansville and distributed by Industrial Insulation Co. of Los Angeles, Calif. The blanket has an initial thickness of approximately 1" and is compressed to a thickness of approximately ½". The blanket also has a density of approximately 10 pounds per cubic foot. The liner 51, as thus wrapped, is axially inserted within a cup-shaped portion of the cylindrical primary combustor shell 52 from the lower end thereof. A conical portion 55 is then inserted over and around the throat portion of the wrapped liner and the assembly is welded at 56. In this manner, the liner 51 is compliantly supported from the shell 52 such that there are no point loads applied to the liner 51, and the liner can move within the shell 52 such that differences in thermal expansion are fully accommodated.

The inside wall of the pressure vessel 26 is also lined with a layer of fibrous refractory thermally insulative material at 61. This liner 61 is free-standing and rigid and formed in the same manner as liner 51. However, it is not densified as previously described. In a typical manner, the liner 61 is made of Type MD2000 Mullite fibers of silica and alumina having a density of 10–30 pounds per cubic foot and having a thickness of approximately 1".

In a typical physical realization of the combustor 13, the pressure vessel 26 is made of stainless steel having a wall thickness of 0.125" having a diameter of approximately 21" and a length of approximately 52". The primary combustion chamber shell 52 has an axial length of approximately 29" and the inside diameter of the free-standing liner 51 has a diameter of approximately 13". The radiation cooling portion 44 of the secondary combustion chamber has an axial length of approximately 10" and subtending approximately 5 rings of air-cooling holes 45, each having a diameter of approximately 0.10" and there being 48 cooling holes per ring. The ring-cooling members 46 disposed inside each of the rings of air-cooling holes, have an axial separation of approximately 2" in zone 44, whereas in the remaining portion of the secondary combustion chamber 25 the rings 46 are axially spaced by 2.5" to 3". There are 12 one-inch diameter secondary air-cooling ports 43 and 6 one-and-a-half inch diameter dilution air ports 48. Ring-cooling members 46 have an axial extent of approximately 1". Of the approximately 6.8 kilograms per second of compressed air inducted into the combustor 13, 2.6 kilograms per second pass through the dilution ports 48, 1.75 kilograms per second pass through the secondary combustion ports 43, 0.8 kilograms per second are inducted into the primary combustion chamber 24 through the swirler 29 wherein it is mixed with approximately 0.08 kilograms per second of Bakersfield, Calif. crude. And, approximately, 1.67 kilograms per second of the compressed air is fed through the air-cooling ports 45 for cooling the walls of the secondary combustion chamber, including the radiation cooling portion thereof.

The advantages of the staged gas turbine combustor 13 of the present invention include:

1. Low $NO_x$ emissions, i.e., 44 ppm referenced to 15% oxygen compared to the U.S. National EPA standard of 75 ppm for stationary gas turbines when combusting nitrogen-containing crude oil.

2. Low carbon monoxide emissions, i.e., below 100 ppm referenced to 15% oxygen in the exhaust.

3. Ability to burn heavy crude oil. Conventional gas turbine combustors are unable to burn heavy fuel oil such as heavy crude oil. The combustor of the present invention permits the use of heavy crude oil which is the lowest cost fuel available in some locations such as in the thermally-enhanced oil recovery operations in the vicinity of Bakersfield, Calif.

4. Unrestricted starts and stops are permitted without inflicting thermal shock damage to the combustor components.

5. The combustor of the present invention permits extended periods of operation without need of parts replacement or excessive maintenance.

6. The configuration of the present invention permits ease of inspection, disassembly and replacement of combustion liners and fuel nozzles as required during normal maintenance intervals.

What is claimed is:

1. In a staged gas turbine combustor having a primary combustion chamber for containing a fuel-rich combustion zone followed by a secondary combustion chamber for containing a secondary combustion zone for combusting the unburned combustion products exhausting from said primary combustion chamber:

liner means for lining the interior wall of said primary combustion chamber with a layer of porous fibrous refractory thermally insulative material; and coating means infiltrated into said lining material from the interior wall thereof for coating the fibers of said fibrous lining material with a coating of refractory coating material so as to produce a radial gradient in the density of the resultant coated fibrous lining with decreasing density taken in the radial direction from the interior surface thereof toward the outer surface thereof, whereby the interior region of the infiltrated and coated refractory lining is rendered resistant to erosion by combustion products within the primary combustion chamber of the gas turbine combustor.

2. The combustor of claim 1 wherein the coating means is selected from the group consisting of zirconia, and refractory carbides.

3. The gas turbine combustor of claim 1 wherein the fibers of said fibrous thermally insulative material are made of alumina.

4. In a staged gas turbine combustor:

primary combustion chamber means including a rigid shell portion for containing a primary combustion zone in which fuel and air are burned to produce resultant combustion products;

secondary combustion chamber means disposed to receive the combustion products exhausting from said primary combustion chamber means and for adding air thereto and for burning unburned components of the combustion products exhausting from said primary combustion chamber in a secondary combustion zone contained within said secondary combustion chamber means;

lining means for lining the interior wall of said rigid shell portion of said primary combustion chamber means and including a rigid lining member of porous fibrous refractory thermally insulative material shaped and dimensioned to fit within and generally conform in shape at its exterior to the inside wall of said shell portion of said primary combustion chamber means with a clearance space between the outer wall of said rigid member and the inner wall of said shell portion of said primary combustion chamber means; and a layer of compliant fibrous refractory thermally insulative material interposed in said clearance space in supportive engagement between said rigid lining member and the surrounding interior wall of said shell portion of said primary combustion chamber means so as to support said lining member and to distribute support induced stress evenly over its exterior surface.

5. The staged gas turbine combustor of claim 4 wherein said shell portion of said primary combustion chamber means is made of metal having a substantially different temperature coefficient of expansion than that of said rigid lining member, whereby said compliant fibrous layer of thermal insulation flexes to accomodate thermally induced relative changes in the dimensions of said supported rigid lining member and the surrounding metallic shell portion of said combustion chamber means occasioned by rapid thermal cycling of said primary combustion chamber means.

* * * * *